US005298943A

United States Patent [19]

Ide et al.

[11] Patent Number: 5,298,943

[45] Date of Patent: Mar. 29, 1994

[54] IMAGE FORMING APPARATUS FOR CORRECTING IMAGE DENSITY DRIFT

[75] Inventors: Naoaki Ide; Rintaro Nakane, both of Yokohama, Japan

[73] Assignee: Kabushiki Kaisha Toshiba, Kawasaki, Japan

[21] Appl. No.: 964,271

[22] Filed: Oct. 21, 1992

[30] Foreign Application Priority Data

Oct. 21, 1991 [JP] Japan ..... 3-271665
Sep. 24, 1992 [JP] Japan ..... 4-280525

[51] Int. Cl.[5] ..... G03G 21/00

[52] U.S. Cl. ..... 355/208; 355/203; 355/214; 355/246

[58] Field of Search ..... 355/210, 200, 246, 219, 355/203, 208, 205, 214, 211

[56] References Cited

U.S. PATENT DOCUMENTS 4,390,265 6/1983 Suzuki et al. ..... 355/214 X
4,536,082 8/1985 Motohashi et al. ..... 355/246 X
4,563,081 1/1986 Sato ..... 355/208
4,879,577 11/1989 Mabrouk et al. ..... 355/214 X
5,034,772 7/1991 Suzuki ..... 355/208

FOREIGN PATENT DOCUMENTS 61-238070 10/1986 Japan .
2-77766 3/1990 Japan .
2-149867 6/1990 Japan .

*Primary Examiner*—A. T. Grimley
*Assistant Examiner*—Shuk Y. Lee
*Attorney, Agent, or Firm*—Foley & Lardner

[57] ABSTRACT

In a printer apparatus according to the present invention, the amount of charge applied to a photoconductor is measured at at least two points. A variation in dark decay which controls an image density, is recognized for the developing position of each developing unit. The grid bias voltage applied to the grid screen of the main charging device and the developing bias voltage applied to each of the developing units are set so as to satisfy the intensities of the contrast voltage and background voltage predetermined for each of the developing positions of the developing units.

9 Claims, 8 Drawing Sheets

IMAGE FORMING APPARATUS FOR CORRECTING IMAGE DENSITY DRIFT

BACKGROUND OF THE INVENTION

1. Field of the Invention

This invention relates to an image forming apparatus and, more specifically, to an image forming apparatus such as a multicolor printer apparatus or a full-color copying apparatus utilizing an electrophotographic process.

2. Description of the Related Art

In the copying (printer) apparatus, it is known that the surface potential applied to the photoconductor depends on its environmental temperature, and moisture and on the number of accumulated copying sheets.

The surface potential of the photoconductor is particularly important in a full-color process. A variation in an amount of toner degrades the color balance of a formed image. Consequently, the intensity of the developing voltage applied to each developing device for every process has to be set to a fixed value, irrespective of the number of times the process is repeated.

Therefore, in the copying (printer) apparatus, a given allowable margin is provided to image forming materials and an image forming process itself, and image stabilization is attained by maintenance within this allowable margin.

However, the allowable margin to be provided to the image forming materials and image forming process itself is limited, and the maintenance required much labor and cost. Furthermore, the image density drift cycle is shorter than a maintenance cycle, and a stable image density cannot always be obtained by only the maintenance.

A method has been so far proposed to keep the surface potential applied to the photoconductor to a fixed value.

The method is that the surface potentials applied to a photoconductor are measured directly after charge is supplied from the charging device. A decay curve is obtained by the measured surface potentials to control the intensity of charge supplied from the charging device to the photoconductor. This method is disclosed in Published Unexamined Japanese Patent Applications Nos. 61-238070 and 2-77766.

However, the above methods have the following drawbacks.

In the method of Published Unexamined Japanese Patent Application No. 61-238070, since the sensors for sensing the surface potential are very expensive, production costs greatly increase. If a sensor is provided for each of the developing devices, the production costs excessively increase. Further, the apparatus has to increase in size because it includes plural sensors. If the apparatus includes a plurality of developing devices the expensive sensors have to be protected from movement of the developing devices.

In the method of Published Unexamined Japanese Patent Application No. 2-77766, the photoconductor is intermittent and, in this case, no image can be formed during the measurement of potentials.

SUMMARY OF THE INVENTION

It is an object of the present invention to provide an image forming apparatus, which can correct an image density drift due to a change in environment or a deterioration over time independently of the maintenance and at a shorter cycle than the maintenance cycle, can stabilize a high image density, and for forming a color image of constant color balance.

According to one aspect of the present invention, there is provided an image forming apparatus for forming an image on a rotatable recording medium, comprising:

means for charging the photoconductive drum;

means for forming a latent image corresponding to image data on the rotatable recording medium;

means for sensing an intensity of the charge applied to the rotatable recording medium at least two points with respect to a first area where a latent image is formed and a second area where no latent image is formed while the rotatable recording medium rotates;

first estimation means for estimating a first decay character of the rotatable recording medium based on the intensity of the charge in the first area sensed by said sensing means;

second estimation means for estimating a second decay character of the rotatable recording medium based on the intensity of the charge in the second area sensed by said sensing means;

means for developing the latent image formed on the rotatable recording medium;

means for calculating an amount of charge applied to the rotatable recording medium and a developing bias voltage applied to said developing means based on the first decay character estimated by said first estimation means and the second decay character estimated by said second estimation means; and means for changing the intensity of changed from said charging means and the developing bias voltage applied to said developing means based on a result obtained by said calculation means.

According to another aspect of the present invention, there is provided an image forming apparatus for forming a color image on a photoconductive drum process, comprising:

charging means for applying the charge to the photoconductive drum said charging means including a corona wire for generating a charge and a grid screen for generating a grid bias voltage to change an intensity of the charge generated from the corona wire;

exposing means for forming a latent image corresponding to image data on the photoconductor drum;

developing means for developing the latent image formed on the image bearing member, said developing means including a plurality of developing unit for forming a color image;

first sensing means for sensing an intensity of the charge applied to the photoconductive drum at least two points corresponding to different times when the charge is applied to the photoconductive drum and when the photoconductive drum rotates at least once, with respect to a first area where a latent image is formed and a second area where no latent image is formed;

second sensing means for sensing an amount or factor of variation in the gradation characteristic of the image;

first estimation means for estimating a first decay character and a second decay character of the photoconductive drum based on the intensity of the charge sensed by said first sensing means whenever an image is formed in an area between each of said plurality of developing units and the photosensitive drum;

second estimation means for estimating the intensity of a bias voltage for the each of said plurality of developing units, based on the intensity of the charge sensed by said first sensing means and the first and second decay characters estimated by said first estimation means;

means for calculating an intensity of the charge applied to the photoconductive drum and an intensity of the bias voltage applied to each of the developing units based on the first and second decay characters of said photoconductive drum estimated by said first estimation means, the bias voltage applied to the each of the developing units thereof estimated by said second estimation means, and the amount or the factor in variation in gradation characteristic sensed by said second sensing means; and means for changing the intensity of charge from said charging means and the developing bias voltages applied to the each of the developing units based on a result obtained by said calculating means.

In the image forming apparatus according to the present invention, the amount of charge applied to the photoconductor is measured at at least two points which differ in decay level. A variation in dark decay, which controls an image density, is recognized for the developing position of each developing unit. The grid bias voltage applied to the grid screen of the main charging device and the developing bias voltage applied to each of the developing units are set so as to satisfy the intensities of the contrast voltage and background voltage predetermined for each of the developing positions of the developing units.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
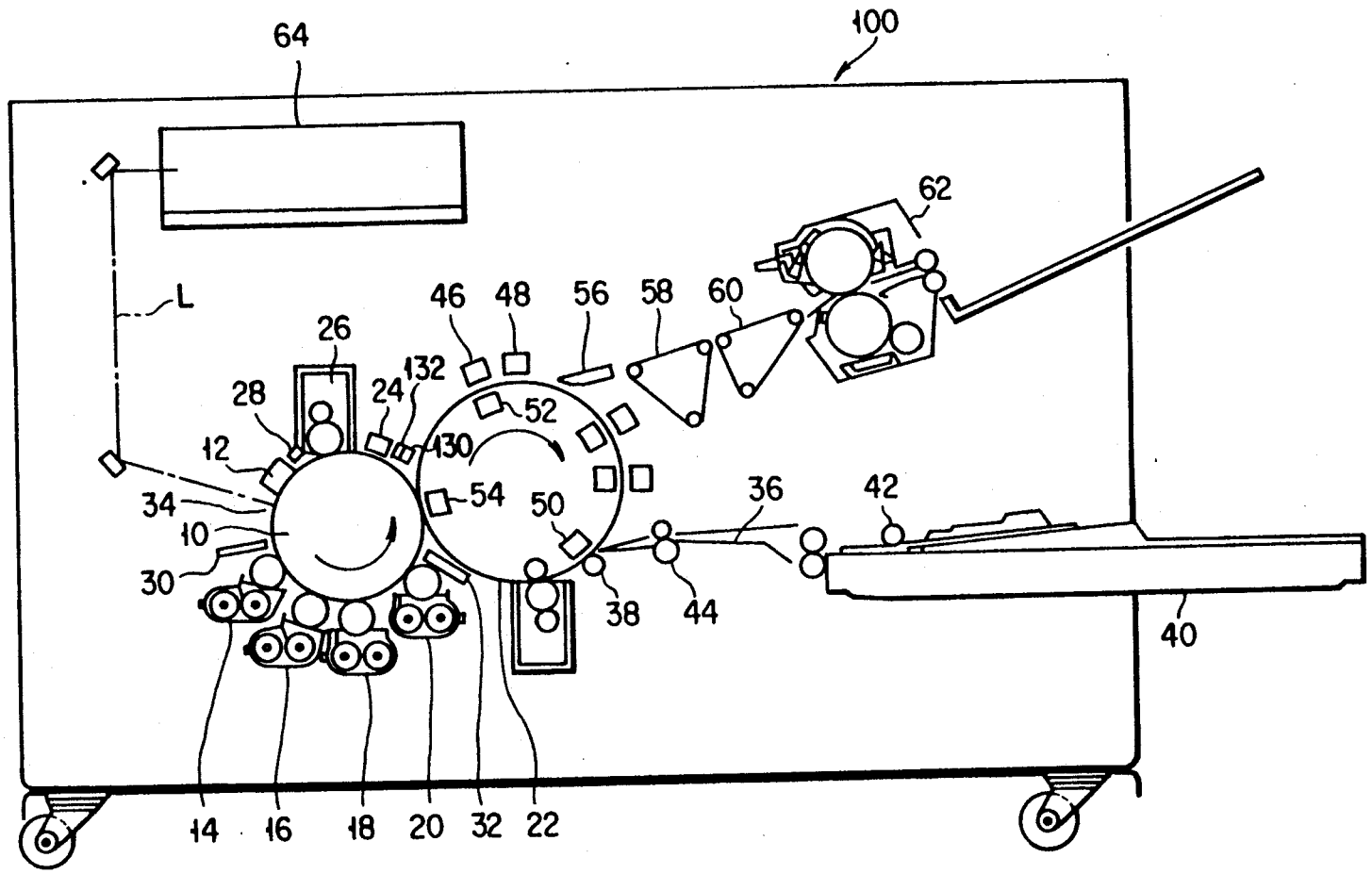
FIG. 1 is a schematic sectional view of a color printer apparatus according to an embodiment of the present invention.
Figure 2:
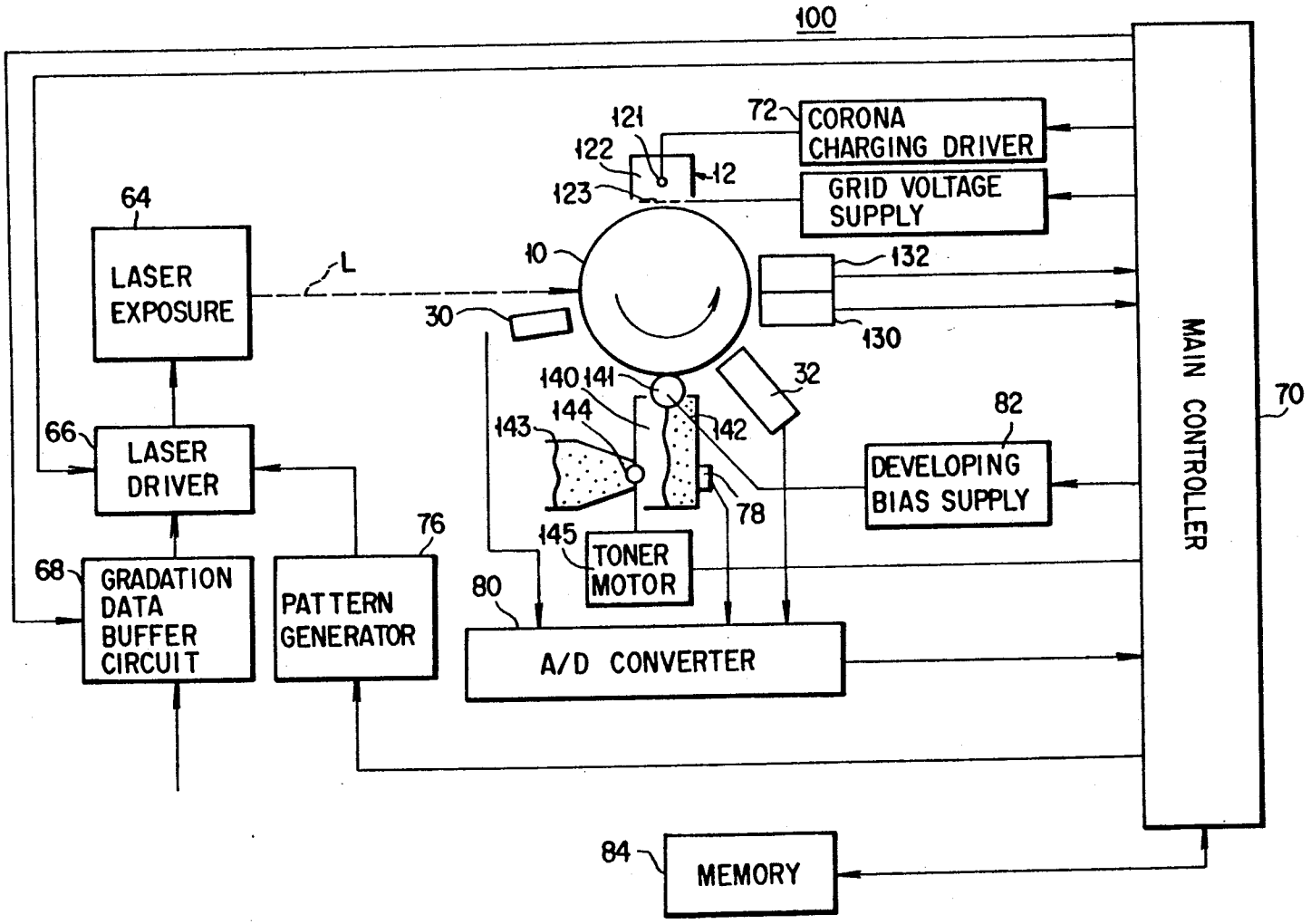
FIG. 2 is a block diagram of the main part of the color printer apparatus shown in FIG. 1.

FIGS. 1 and 2 show a color laser beam printer apparatus according to the present invention.

The printer apparatus 100 shown in FIG. 1 includes a photoconductor 10 which can be rotated in the direction of an arrow and on which information to be printed out is electrostatically formed through an electrophotographic process.

A main charging unit 12 for applying a desired charge to the surface of the photoconductor 10, and first, second, third and fourth developing units 14, 16, 18 and 20 for supplying toners having different colors to an electrostatic latent image formed on the surface of the photoconductor 10 and visualizing the latent image (forming a toner image), are arranged around the photoconductor 10 in its rotating direction. For example, toners of magenta, cyan, yellow and black are supplied to the first to fourth developing units 14, 16, 18 and 20, respectively.

A transfer drum 22 for opposing a paper sheet on which the toner image is printed to the photoconductor 10, is arranged after the fourth developing unit 20 in the rotating direction of the photoconductor 10 so as to have a predetermined interval between the photoconductor 10 and the transfer drum 22. The rotation axes of the photoconductor 10 and the transfer drum 22 are parallel with each other. The circumference of the transfer drum 22 is slightly larger than the maximum length of the paper capable of forming an image.

Further, a precleaning discharger 24, a cleaner unit 26 and a discharging lamp 28 for removing the toners remaining on the surface of the photoconductor 10 and returning charge distribution to the initial state, are arranged in order around the photoconductor 10.

A surface potential sensor 30 for measuring the intensity of the charge applied to the photoconductor 10 by the main charging unit 12 is arranged between the main charging unit 12 and the first developing unit 14, and an attached-toner sensor 32 for measuring the amount of toner attached to the photoconductor 10 by the first to fourth developing units 14, 16, 18 and 20 is arranged between the fourth developing unit 20 and the transfer drum 22. A slit area 34 for guiding a laser beam from a laser exposer, which will be described later, to the surface of the photoconductor 10, is formed between the surface potential sensor 30 and the first developing unit 14. Furthermore, a temperature sensor 130 for measuring the environmental temperature of the photoconductor 10 and a humidity sensor 132 for measuring the environmental humidity thereof are arranged around the photoconductor 10 so that they can easily be maintained from outside.

A paper guide 36 for guiding paper to the transfer drum 22 to wind it around the drum 22, a forward roller 38 for sending out the paper in the rotating direction of the transfer drum 22, and first and second separating dischargers 46 and 48 for separating the paper to which the toner image has been transferred, from the transfer drum 22, are arranged in sequence around the transfer drum 22 in its rotating direction. A paper cassette 40 is able to store a plurality of paper sheets and is detachable from the printer apparatus 100, and the paper sheets are fed to the guide 36 through a feed roller 42, and then the forward roller 38 through a registration roller 44.

An attraction charger 50 for electrostatically attracting the paper sent out by the forward roller 38 to the surface of the transfer drum 22, is arranged inside the transfer drum 22 and opposite to the forward roller 38. An inside separating discharger 52 for separating the paper to which the toner image is transferred, from the transfer drum 22 in association with the first separating discharger 46, is arranged inside the transfer drum 22 and opposite to the first separating discharger 46. A transfer charger 54 for transferring the toner image formed on the surface of the photoconductor 10 to the paper wound around the transfer drum 22, is formed in a position (hereinafter referred to as a transfer area) inside the drum 22 opposite to the photoconductor 10 or in a position between the forward roller 38 and the inside separating discharger 52.

A separator 56 for separating the paper, which is wound around the transfer drum 22 and to which the toner image is transferred, is arranged around the transfer drum 22 and away from the photoconductor 10. First and second conveyors 58 and 60 for feeding the paper to which the toner image is transferred, outside the printer apparatus 100, is arranged next to the separator 56 in the paper feeding direction, and a fixing unit 62 for heating the toner image and fixing it on the paper, is arranged next to the second conveyor 60.

A laser exposer 64 for emitting a laser beam modulated based on information to be recorded or image data, is disposed in the vicinity of the photoconductor 10 so that the laser beam can be emitted to the slit area 34. Needless to say, a mirror for guiding the laser beam to the surface of the photoconductor 10 can be arranged between the laser exposer 64 and the slit area 34 in accordance with the position of the laser exposer 64.

The laser exposer 64 includes, for example, a semiconductor laser element (not shown) for emitting a laser beam, a laser driver 66 for turning on/off a laser beam, a gradation data buffer circuit 68 for varying the intensity of a laser beam based on data (gradation data), a photodetector (not shown) for monitoring a variation in power level of a laser beam and a polygonal mirror (not shown) for substantially linearly deflecting a laser beam in a direction perpendicular to the direction in which the photoconductor 10 is rotated.

Operation of the printer apparatus 100 will now be described.

In the printer apparatus 100, the photoconductor 10 is rotated at a desired speed (circumference moving speed) in the direction of an arrow by means of a motor (not shown) energized in response to a motor drive signal from a control circuit (not shown). The surface of the photoconductor 10 is almost uniformly charged by the main charging unit 12 to have a desired surface potential. A first laser beam corresponding to an image which has to be developed by a magenta toner which is stored in the first developing unit 14 and whose color is separated in accordance with a color component included in information to be recorded, is emitted from the laser exposer 64 to the slit area 34 of the charged photoconductor 10.

An electrostatic latent image corresponding to the magenta toner is formed on the surface of the photoconductor 10 to which the laser beam has been emitted. The latent image is developed by the magenta toner and converted into a magenta toner image.

The magenta toner image formed on the photoconductor 10 is electrostatically carried to the transfer area.

A piece of paper is drawn from the paper cassette 40 through the feed roller 42 at the same time when the magenta toner image is formed on the surface of the photoconductor 10. The paper is fed from the feed roller 42 to the registration roller 44 along the paper guide 36 by propelling power. The registration roller 44 temporarily stops the paper fed from the feed roller 42 and corrects an inclination perpendicular to the paper feeding direction. When the photoconductor 10 rotates and the toner image formed thereon is transported to a desired position, the paper is separated from the registration roller 44 and guided to the forward roller 38. The paper is guided to the surface of the transfer drum 22 through the forward roller 38 and attracted thereto by the attraction charger 50. When the transfer drum 22 rotates, the paper is attracted to the surface thereof and guided to the transfer area. In the transfer area, the paper wound on the transfer drum 22 opposes the magenta toner image formed on the photoconductor 10 at a slight interval. The transfer charger 54 is energized, and the magenta toner image is transferred to the paper. The magenta toner image transferred to the paper is electrostatically held when the transfer drum 22 is further rotated.

A toner image remaining on the surface of the photoconductor 10, after the magenta toner image is transferred to the paper on the transfer drum 22, is eliminated by the precleaning discharger 24 and cleaner unit 26 while the photoconductor 10 is rotating. The photoconductor 10 from which the remaining toner image is eliminated, is further rotated and, when the discharging lamp 28 is turned on, the charge distribution of the surface of the photoconductor 10 is returned to the initial state.

The photoconductor 10 whose charge distribution has been returned to the initial state, is charged again by the main charging unit 12. A second laser beam corresponding to an image which has to be developed by a cyan toner which is stored in the second developing unit 16 and whose color is separated in accordance with a color component included in information to be recorded, is emitted from the laser exposer 64 to the slit area 34 of the charged photoconductor 10. A second electrostatic latent image corresponding to the cyan toner is formed on the surface of the photoconductor 10 to which the second laser beam is emitted. The second latent image is developed by the cyan toner and converted into a cyan toner image.

The cyan toner image formed on the photoconductor 10 is carried to the transfer area. The cyan toner image carried to the transfer area is transferred onto the paper on which the magenta image (first toner image) has been transferred, by means of the transfer charger 54. In other words, the cyan image is superimposed on the magenta image.

A toner image remaining on the surface of the photoconductor 10, after the cyan toner image is transferred to the paper on the transfer drum 22, is eliminated by the precleaning discharger 24 and cleaner unit 26 while the photoconductor 10 is rotating. The charge distribution of the surface of the photoconductor 10 is returned to the initial state by the discharging lamp 28.

The processes of forming the latent image, and transferring and cleaning the toner image are repeated in accordance with all color components contained in information to be recorded. In each of the processes, a yellow toner and a black toner are superimposed in order on the paper sheet on the transfer drum 22.

A charge having a desired polarity is applied to the paper sheet on which all the toners are superimposed, by the first, second and inside separating dischargers 46, 48 52. Thus, the electrostatic attraction of the transfer drum 22 is released, with the toner superimposed on the surface of the paper sheet. The paper is thus separated from the surface of the transfer drum 22 by the separator 56, and fed to the fixing unit 62 through the first and second conveyors 58 and 60. The toner on the sheet paper is melted by heat generated from the fixing unit 62, fixed onto the surface of the paper sheet, and externally supplied as printing (hard copy).

A well-known printing technique is applied in order to separate colors, superimpose magenta, cyan and yellow toners in this order, and add a black toner after color toners corresponding to black toner are previously removed.

As shown in FIG. 2, the main charging unit 12 includes a corona wire 121, a conductive case 122, and a grid screen 123. The corona wire 121 is connected to a corona charging driver 72 to supply charge to the surface of the photoconductor 10, as has been described in FIG. 1. The grid screen 123 is connected to a grid voltage supply 74 to set the intensity of the charge supplied to the photoconductor 10 through the corona charging driver 72 to a desired value. Needless to say, the corona charging driver 72 and grid voltage supply 74 are controlled by main controller 70.

A laser beam, which is modulated based on gradation data, is emitted from the laser exposer 64 to the surface of the photoconductor 10 which is charged by the main charging unit 12 and guided to a position corresponding to a slit area 34 by rotating the photoconductor 10. An electrostatic latent image corresponding to the laser beam is thus formed on the surface of the photoconductor 10.

The gradation data is supplied through a gradation data buffer circuit 68. The gradation data buffer circuit 68 includes a memory for storing data transmitted from the main controller 70 or an external device (not shown), and generates a laser modulation signal for modulating the laser beam based on the gradation data. The laser modulation signal is a signal for changing the density of an image to express gradation when the image is formed and for defining the power of the laser beam emitted to the photoconductor 10 as a period of time (pulse duty=PD) during which the laser beam is being emitted.

The laser beam is turned on/off by a laser driver 66. The laser driver 66 allows the laser beam to be emitted from a desired exposure starting position in a direction perpendicular to a rotating direction of the photoconductor 10, in response to a trigger pulse output from the main controller 70. Thus, the laser beam emitted from the laser exposer 64 is modulated in accordance with the pulse duty, and guided to the surface of the photoconductor 10 in response to the trigger pulse output from the main controller 70 when the rotation of the photoconductor 10 is synchronized with that of a polygonal mirror (not shown). At the same time, the laser driver 66 keeps the intensity (power) of a laser beam emitted from a semiconductor laser element in accordance with a variation in the intensity of the laser beam detected by a photodetector (not shown). The laser driver 66 is supplied from a pattern generator 76 with pattern data for a test pattern of the printer 100 and gradation pattern data for measuring a toner attaching amount. The pattern data and pulse duty PD are selectively supplied to the laser driver 66 by the main controller 70.

The amount of charge applied to the photoconductor 10 through the main charging unit 12, is measured as a surface potential of the photoconductor 10. In the printer 100 shown in FIG. 2, the surface potential is measured by the surface potential sensor 30 arranged between the first developing unit 12 and slit area 34. A signal output from the surface potential sensor 30 is converted into a digital signal by a converter, and the digital signal is transmitted to the main controller 70. In the main controller 70, a dark decay character and a light decay character of the photoconductor 10 are estimated by the process described later. Note that the dark decay character shows that the charge (surface potential) applied to the photoconductor is dropped out without exposure, and the light decay character shows that the charge is dropped out after it is released by the laser exposer. The light decay character includes the surface potential which is risen by recovering dark decay and light fatigue of the photoconductor until the charge is released by the laser exposer.

The electrostatic latent image formed on the surface of the photoconductor 10 is transferred to a developing area between the photoconductor 10 and developing unit 140 when the photoconductor 10 is rotated. The latent image is visualized (developed) by toner supplied from the developing unit 140 and converted into a toner image. The developing unit 140 includes a developing roller 141, is arranged opposite to the photoconductor 10, for developing the latent image and a carrier member for triboelectrically charging the toner. The developing unit 140 includes a main body 142, stores a developer of a mixture of the toner and carrier member, for supplying the developer to the developing roller 141 and supplies only the toner to the latent image. The weight percentage of the toner contained in the developer (hereinafter referred to as toner density=T/D) has to be almost constant. The toner density is measured by a toner density measuring unit 78. A signal shows the T/D output from the toner density measuring unit 78 is converted into a digital signal by an A/D converter 80, and the digital signal is supplied to the main controller 70. The developing unit 140 includes a toner storage 143 for storing toner to be supplied to a latent image, a toner roller 144 for carrying toner from the toner storage 143 to the main body 142, and a toner motor 145 for rotating the toner roller 144. The toner motor 145 is energized in response to a toner motor control signal output from the main controller 70, and the main body 142 is replenished with toner supplied from the toner storage 143 when the toner roller 144 rotates. The developing roller 141 includes a conductive layer, and a developing bias voltage $V_{BD}$ can be applied thereto through a developing bias supply 82. When the latent image formed on the surface of the photoconductor 10 is converted into a toner image, the amount of toner supplied from the developing roller 141 to the photoconductor 10 by the difference between the developing bias voltage and the surface potential is called a developing (image forming) voltage is controlled. Needless to say, the developing bias voltage (output signal of the developing bias supply 82) $V_{BD}$ is controlled by the main controller 70.

Figure 3:
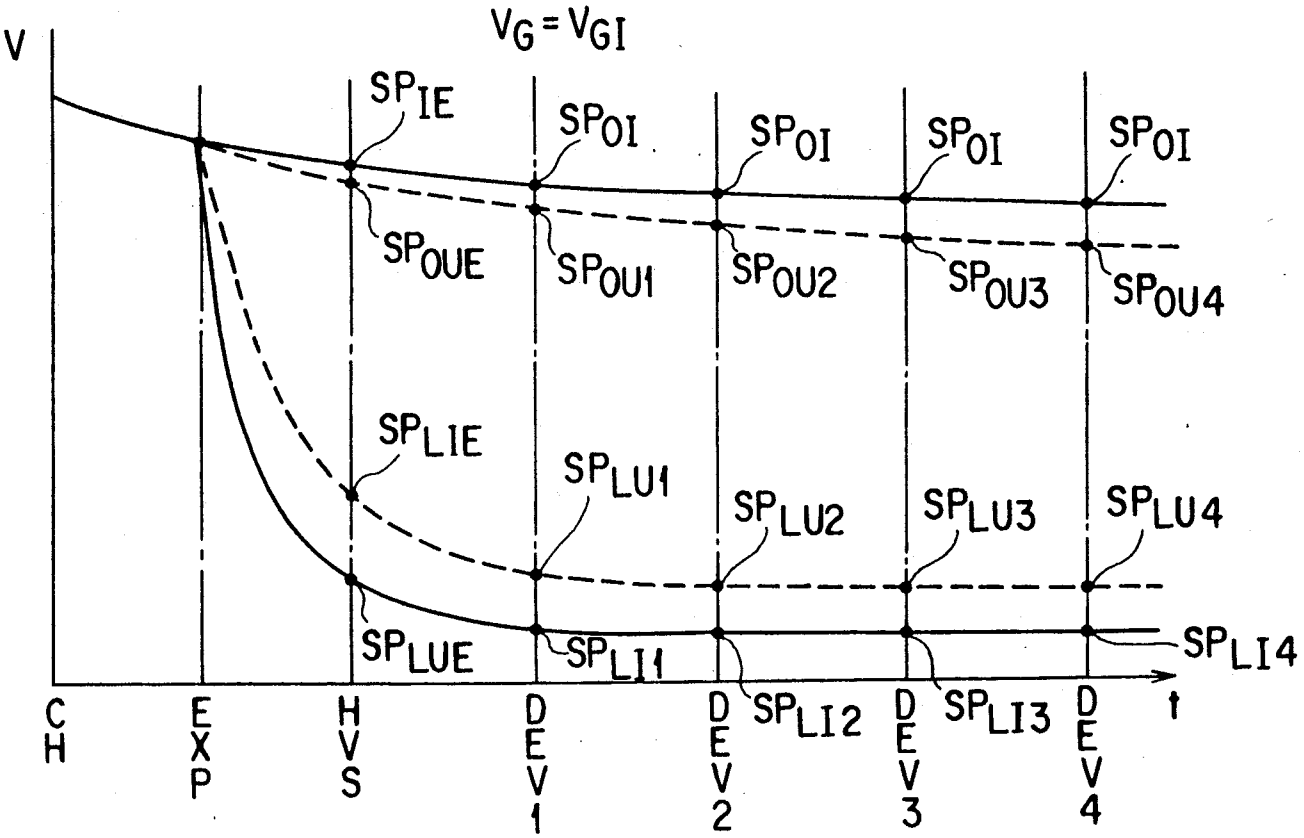
FIG. 3 is a graph showing a correlation between the grid bias voltage, developing bias voltage, contrast voltage, and background voltage, with respect to the surface potential of the photoconductor and the desired developing position.

FIG. 3 shows decay characters of an exposed area and an unexposed area of the photoconductor 10 with respect to time t elapsed from the time when the photoconductor 10 is charged. In FIG. 3, when an image is formed by the first developing unit 14, the initial grid bias voltage applied to the grid screen of the main charging unit 12 for determining an amount of charge applied to the photoconductor 10 is $V_{G1}$. In FIG. 3, the solid lines show the potentials of the exposed and unexposed areas on the photoconductor 10 which is in the initial state, and the broken lines show the potentials of the exposed and unexposed areas on the photoconductor 10 which has been used for a long time.

If the photoconductor 10 rotates at a fixed speed, the locations of the devices and units, which are arranged around the photoconductor 10, that is, the main charging unit 12, the exposure position (slit area) 34, the surface potential sensor 30, and the first to fourth developing units 14, 16, 18 and 20, correspond to the time t elapsed from the time when the photoconductor 10 is charged.

The main charging unit 12, the exposure position (slit area) 34, the surface potential sensor 30, and the first to fourth developing units 14, 16, 18 and 20, are represented as CH, EXP, HVS, and DEV1 to DEV4. If the initial grid bias voltage $V_{G1}$ is fixed to the first developing unit 14 (DEV1), the potential of the unexposed area of the photoconductor 10 which reaches the location (time) of the DEV1 is represented as $SP_{OI1}$ when the photoconductor 10 is in the initial state. If the decay character of the photoconductor 10 is changed with its long use, the potential of the unexposed area can be represented as $SP_{OU1}$. The potential of the exposed area is represented as $SP_{LI1}$ when the photoconductor 10 is in the initial state, and it is represented as $SP_{LU1}$ when the photoconductor 10 is used for a long time. The variation in these potentials can be confirmed by the decay character of the photoconductor, described later. If the grid bias voltage is fixed as described above, the density and gradation of a developed image will be varied with the surface potential characteristic including the decay character of the photoconductor 10.

Figure 4:
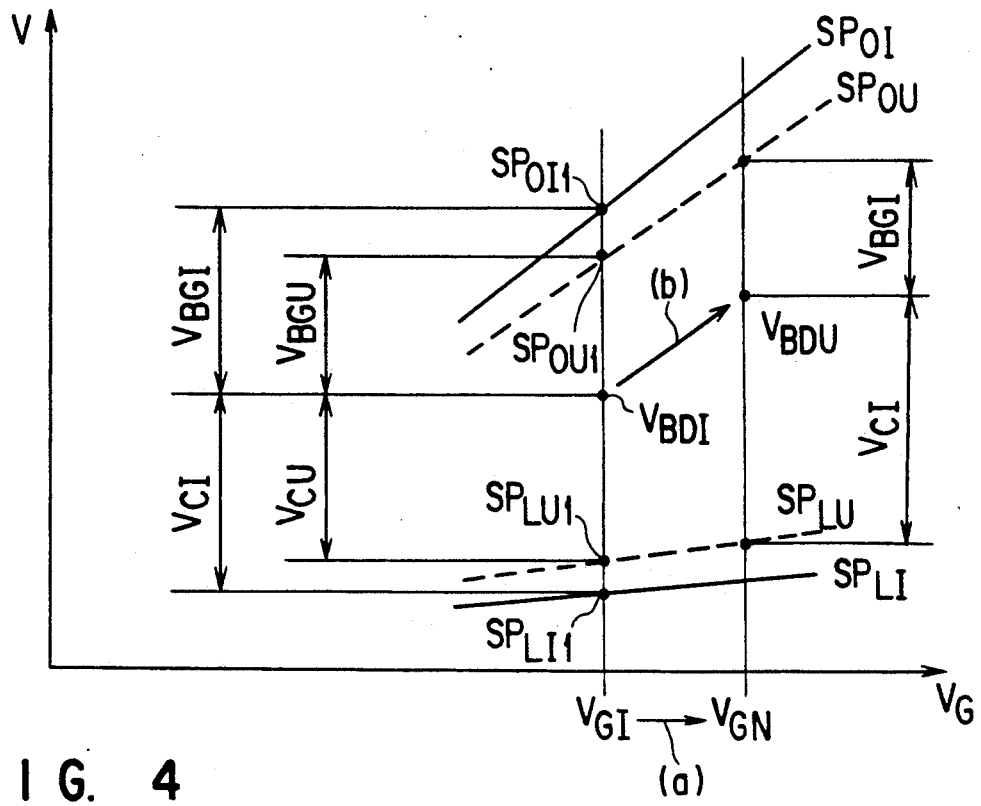
FIG. 4 is a graph showing a correlation between the grid bias voltage, developing bias voltage, contrast voltage, and background voltage, which depend on a variation in the surface potential.

FIG. 4 shows a relationship between the potentials of the exposed and unexposed areas of the photoconductor 10, with respect to the grid bias voltage. In FIG. 4, the solid lines indicate the potential $SP_{LI1}$ of the exposed area and the potential $SP_{OI1}$ of the unexposed area of the photoconductor 10 which reaches the location of the first developing unit (DEV1) 14 shown in FIG. 3 and which is in the initial state, and the broken lines indicate the potential $SP_{LU1}$ of the exposed area and the potential $SP_{OU1}$ of the unexposed area of the photoconductor 10 which has been used for a long time. Since an organic photoconductor is used for the photoconductor 10 of the present invention, the potentials $SP_O$ and $SP_L$ of the unexposed and exposed areas can be linearly approximated in accordance with a variation in the grid bias voltage $V_G$.

Referring to FIG. 4, the variation in the surface potential characteristic of the photoconductor 10 is confirmed as a gradient and an intercept of the linearly-approximated potentials $SP_L$ and $SP_O$.

Referring to FIG. 3, if the grid bias voltage $V_{G1}$ (determined for the developing unit 14) is fixed, it is supposed that the potential $SP_{OI1}$ of the unexposed area of the photoconductor 10 which is in the initial state is changed to the potential $SP_{OU1}$ because of a long use of the photoconductor 10, and the potential $SP_{LI1}$ of the exposed area of the photoconductor 10 which is in the initial state is changed to the potential $SP_{LU1}$. These changes are shown in FIG. 4 as variations in the potentials $SP_L$ and $SP_O$ of the exposed and unexposed areas with the developing bias voltage $V_{BD}$.

If a contrast voltage $V_C$ and a background voltage $V_{BG}$ are parameters representing a relationship between the potentials $SP_L$ and $SP_O$ of the exposed and unexposed areas in the developing position of the developing unit corresponding to the developing bias voltage $V_{BD}$ with respect to the grid bias voltage $V_G$, they can be expressed as follows.

$$V_C = V_{BD} - SP_L \quad (1)$$

$$V_{BG} = SP_O - V_{BD} \quad (2)$$

The features of the contrast voltage $V_C$ and background voltage $V_{BG}$ will be described.

Figure 6:
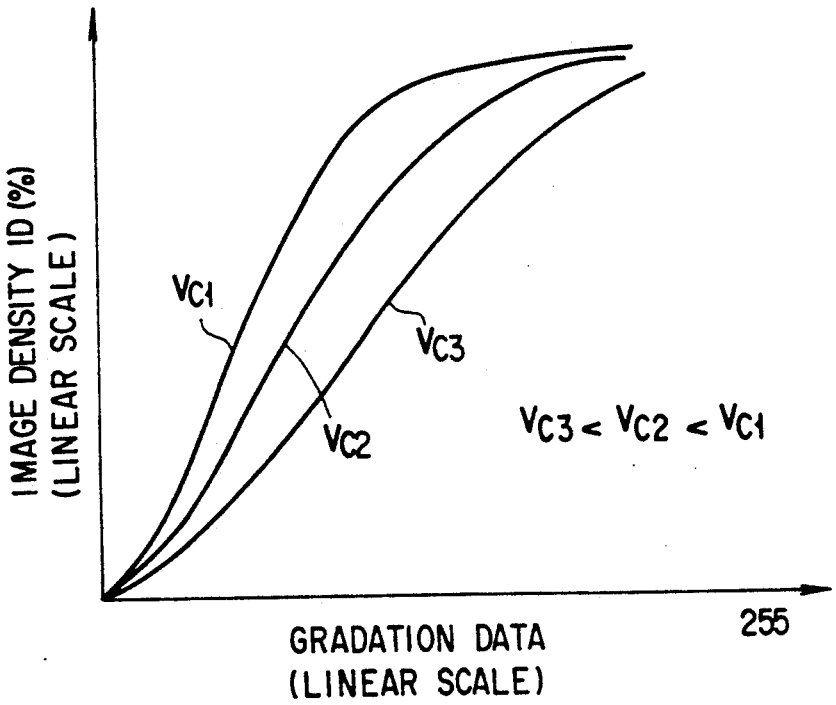
FIG. 6 is a graph showing a relationship between image density and gradation data necessary for copying (printing)
Figure 7:
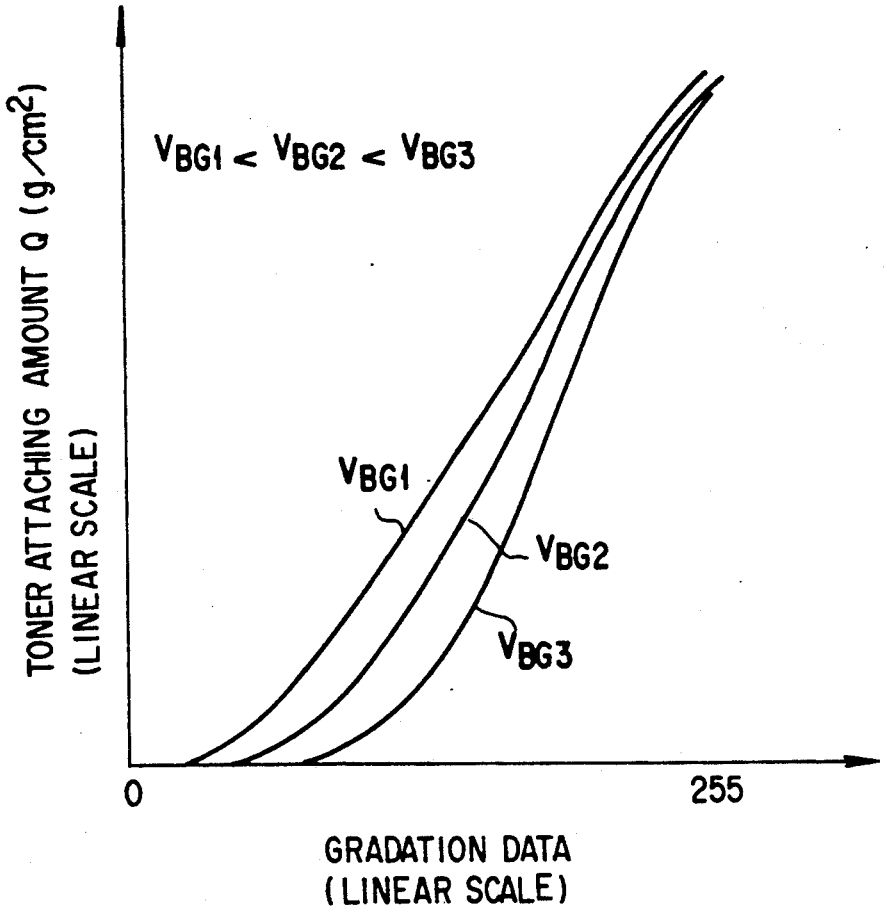
FIG. 7 is a graph showing a relationship between gradation data and toner attaching amount in different background voltages.

The contrast voltage $V_C$ features a variation in gradient of the image density with the gradation data and greatly influences the density of a high-density image. FIG. 6 shows different contrast voltages $V_{C1}$, $V_{C2}$ and $V_{C3}$ and a relationship of $V_{C1} > V_{C2} > V_{C3}$. Similarly, the background voltage $V_{BG}$ greatly influences the density of a low-density image. FIG. 7 shows different background voltages $V_{BG1}$, $V_{BG2}$ and $V_{BG3}$ and a relationship of $V_{BG1} < V_{BG2} < V_{BG3}$. When the background voltage $V_{BG}$ increases, the developing start position moves to the gradation data having a large value.

Referring to FIG. 4 again, if the grid bias voltage is $V_{G1}$ and the developing bias voltage is $V_{BG1}$, when the photoconductor 10 is in the initial state, the contrast voltage $V_C$ and background voltage $V_{BG}$ are changed to $V_{CI}$ and $V_{BGI}$, respectively. When the photoconductor 10 is used for a long time, it can be predicted that the contrast voltage $V_C$ and background voltage $V_{BG}$ are changed to $V_{CU}$ and $V_{BGU}$, respectively. It is, therefore, predicted that the gradation characteristic greatly varies in almost all the areas covering from the low-density area to the high-density area.

In the present invention, the contrast voltage $V_{CU}$ and background voltage $V_{BGU}$ generated by the variation of the attenuation characteristic of the photoconductor 10 can be set to the same voltages $V_{CI}$ and $V_{BGI}$ as when the photoconductor 10 in the initial state, by changing the grid bias voltage $V_G$ and developing bias voltage $V_{BD}$.

A new grid bias voltage $V_{GN}$ and a new developing bias voltage $V_{BDN}$, which are to be changed, can be generated if parameters for determining approximate linear expressions of the potentials $SP_{OU}$ and $SP_{LU}$ of the unexposed and exposed areas with respect to the grid bias voltage $V_G$ whose attenuation coefficient has been changed, and the contrast voltage $V_{CI}$ and background voltage $V_{BGI}$ both generated when the photoconductor 10 is in the initial state. For example, as shown in FIG. 4, the grid bias voltage $V_{GI}$ is changed to $V_{GN}$ (indicated by arrow a) and the developing bias voltage $V_{BDI}$ is changed to $V_{BDU}$ (indicated by arrow b). Therefore, the contrast voltage and background voltage, which are substantially equal to those generated when the photoconductor 10 is in the initial state, can be obtained. It is thus possible to correct a variation in gradation characteristic which is caused by a variation in surface potential characteristic due to a long use of the photoconductor 10.

Since the variation in potential in the developing position is caused by the variation in the surface potential characteristic of the photoconductor 10, the variation in gradation characteristic can be detected by the variation in the surface potential characteristic of the photoconductor 10. If the variation in the surface potential of the photoconductor 10 is detected, the surface potential characteristic of each of the developing units in the developing positions is inferred by the surface potential and attenuation characteristic of the photoconductor 10 (described later) and the grid bias voltage $V_{GN}$ and developing bias voltage $V_{BDN}$ are calculated based on the surface potential characteristic of the photoconductor 10 in order to attain the contrast voltage $V_C$ and background voltage $V_{BG}$ in each of the developing positions. The gird bias voltage $V_{GN}$ and developing bias voltage $V_{BDN}$ are thus changed to correct the gradation characteristic.

Figure 5:
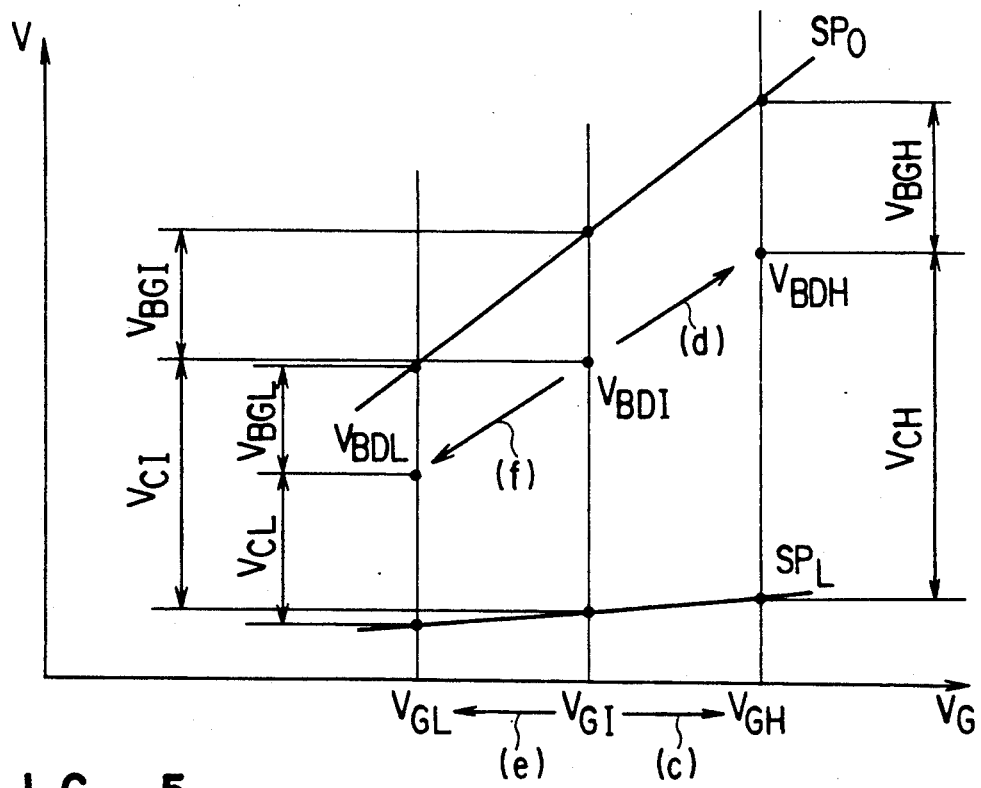
FIG. 5 is a graph showing the correlation between the grid bias voltage, developing bias voltage, contrast voltage, and background voltage, which depends on a variation in temperature and humidity.

Even when the surface potential characteristic of the photoconductor 10 does not vary, as shown in FIG. 5, if the resistance of the developer is changed with humidity to vary the developing characteristic, the grid bias voltage $V_{GN}$ and developing bias voltage $V_{BDN}$ can be changed so that the contrast voltage $V_C$ and background voltage $V_{BG}$ can be obtained in each of the developing positions. For example the gradation characteristic is varied so that the image density becomes lower under the circumstance of low temperature and low humidity. Thus, the contrast voltage $V_C$ and background voltage $V_{BG}$ are slightly increased. As is apparent from FIG. 5, if the grid bias voltage $V_{GI}$ is increased to $V_{GH}$ indicated by arrow c and the developing bias voltage $V_{BDI}$ is increased to $V_{BDH}$ indicated by arrow d, the contrast voltage and background voltage which are substantially the same as those generated when the photoconductor is in the initial state, can be provided. Under the circumstance of high temperature and high humidity, the gradation characteristic is varies so that the image density becomes higher. Therefore, the contrast voltage $V_C$ and background voltage $V_{BG}$V are slightly lowered. As is apparent from FIG. 5, if the grid bias voltage $V_{GI}$ is increased to VGL indicated by arrow e and the developing bias voltage $V_{BDI}$ is increased to $V_{BDL}$ indicated by arrow f, the contrast voltage and background voltage which are substantially the same as those generated when the photoconductor is in the initial state, can be provided.

A main switch (not shown) is turned on, and the main controller 70 reads the environmental temperature and humidity of the photoconductor 10 detected by the temperature sensor 130 and the humidity sensor 132. Based on the temperature and humidity, the main controller 70 determines the power of a laser beam emitted from the laser exposer 64, the amount of charge supplied from the main charging unit 12 to the photoconductor 10, and the developing bias voltages applied to developing rollers included in each of the developing units 14, 16, 18 and 20.

The main controller 70 controls the intensities of the grid bias voltage and the charge output from the grid screen 123 and the corona wire 121 based on temperature data and humidity data input by the temperature and humidity sensors 130 and 132. The temperature data and the humidity data are updated at predetermined intervals of, e.g., 30 minutes. A method of controlling the grid voltage and the charge based on the temperature and humidity data is described in detail in U.S. patent application Ser. No. 720,683 filed on Jun. 25, 1992 by the applicants including the inventor of the present invention.

In the printer apparatus 100, when the grid bias voltage $V_G$ of the main charging unit 12 and the developing bias voltage $V_{BD}$ of the developing unit in the currently developing state are determined, the grid bias voltage $V_G$ and the background voltage $V_{BG}$ are determined by the control curve selected, based on the temperature data and humidity data obtained from the temperature sensor 130 and the humidity sensor 132. As has been described, the temperature data and the humidity data are rechecked almost every 30 minutes since the environmental temperature and humidity of the photoconductor 10 are varied. Therefore, the grid bias voltage $V_G$ and the developing bias voltage $V_{BG}$ are correctly determined.

As is described above, since the variation in gradation characteristic depends on the variation in developing characteristic, it can be detected by the temperature and humidity around the photoconductor 10. If the variation in the temperature and humidity around the photoconductor 10 is detected, the surface potential characteristic of each of the developing units in the developing positions is inferred by the surface potential and decay character of the photoconductor 10 (described later), and the gird bias voltage $V_{GN}$ and developing bias voltage $V_{BDN}$ are calculated based on the surface potential characteristic of the photoconductor 10 in order to attain the contrast voltage $V_C$ and background voltage $V_{BG}$ in each of the developing positions. The gird bias voltage $V_{GN}$ and developing bias voltage $V_{BDN}$ are thus changed to correct the gradation characteristic.

A gradation pattern other than an image to be printed is exposed from the pattern generator 76 on the surface of the photoconductor 10 where a laser beam corresponding to the image does not reach. The gradation pattern is developed by the developing device 140 and then carried to the sensing area of the attached-toner sensor 32 with the photoconductor 10 rotates. The toner attaching amount for the gradation pattern is measured by the attached-toner sensor 32, converted into a digital signal by the A/D converter 80, and supplied to the main controller 70. In the main controller 70, a toner attaching amount signal from the sensor 32 is compared with a reference toner amount stored in a memory 84.

A method of controlling the printer apparatus 100 is described in U.S. patent application No. 855,871 (filed on Mar. 23, 1992) whose inventor(s) is (are) the same as that (those) of the present application.

In the printer apparatus 100, the main charging unit 12, developing unit 140 (units 14, 16, 18 and 20), and laser exposer 64 are controlled in response to various control signals output from the main controller 70. If the amounts of control for these units are varied alone or in combination, the density of an image to be formed can be optimized. For example, the surface potential of the photoconductor is controlled by the main charging unit 12, the developing voltage corresponding to a range between the surface potential and the developing bias voltage (contrast voltage $V_C$ and background voltage $V_{BG}$) $V_{BD}$ applied to the developing unit is controlled by the main charging unit 12 and the developing unit 140, and the toner density is controlled by the toner motor 145 of the developing unit, respectively.

Figure 8:
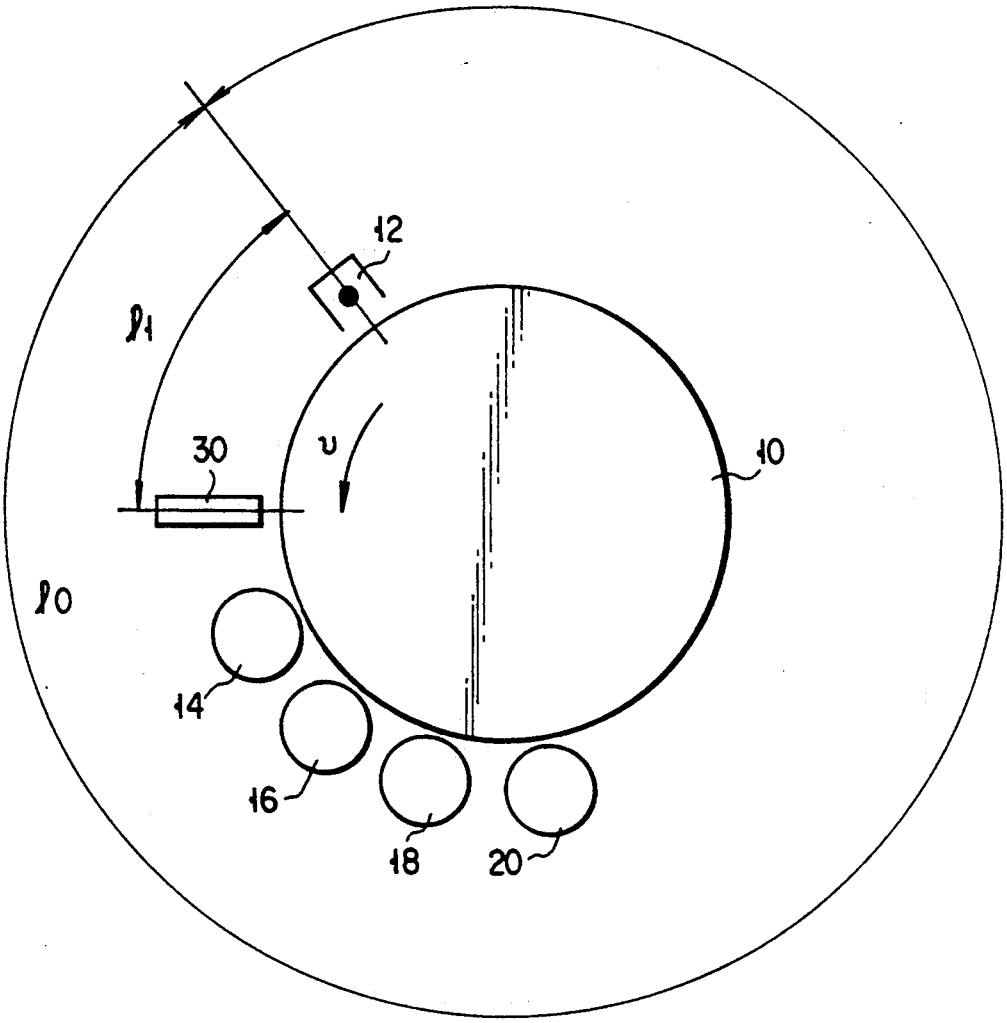
FIG. 8 is a schematic view showing relative position of surface potential sensors on the photoconductor of the color printer apparatus shown in FIGS. 1 and 2.

FIG. 8 shows a process of measuring a surface potential of the photoconductor 10 which is used as one factor for estimating the amount of variation in the contrast voltage $V_C$ and the background voltage $V_{BG}$ in order to change the grid bias voltage $V_G$ of the main charging unit 12.

According to FIG. 8, the unexposed area potential $SP_O$ and exposed area potential $SP_L$ obtained after t seconds (times) are as follows. Each of the times t is relevant to the circumference of the photoconductor 10, and a distance l between a charging position to which a charge is supplied from the main charging unit 12 and each of the developing areas of the developing units 14, 16, 18 and 20 can be obtained from the moving speed of the photoconductor 10).

$$SP_O(t)=a\cdot V_G-b\cdot e^{-ct}+d \quad (3)$$

$$SP_L(t)=p\cdot V_G-q\cdot e^{-rt}+s \quad (4)$$

The following equations are obtained from the equations (1) to (4).

$$VG=(V_C+V_{BG}+b\cdot e^{-ct}-q\cdot e^{-r}+d-s)/(a-p) \quad (5)$$

$$V_{BD}=a\cdot V_G-b\cdot e^{-ct}+d-V_{BG} \quad (6)$$

According to the equations (5) and (6), the grid bias voltage $V_G$ and developing bias voltage $V_{BD}$ can be obtained to apply the contrast voltage $V_C$ and background voltage $V_{BG}$ for securing the optimum developing voltage in each of the developing areas of the developing units 14, 16, 18 and 20 (difference between the surface potential and the developing bias voltage in each developing area). If the toner attaching amount or the surface potential of each of the developing units is measured to calculate the contrast voltage $V_C$ and the background voltage $V_{BG}$, the grid bias voltage $V_G$ and the background voltage $V_{BD}$ are obtained. Incidentally, a, b, c, d, p, q, r, and s in the equations (3) to (6) are constants determined by the characteristics proper to the photoconductor 10. These constants a to d and p to s in the equations (5) and (6) are obtained as follows.

According to FIG. 8, time t (seconds) elapsed after the photoconductor is charged up, with respect to the surface potential measured by the surface potential sensor 30, is given by the following equation.

$$t=l_1/v \quad (7)$$

$l_1$ denotes a distance along the circumference of the photoconductor 10 between a charging position to which charges are supplied from the main charging unit 12 and a surface potential sensor 30, and v indicates a moving speed of the photoconductor 10.

Assuming that the length of the circumference of the photoconductor 10 is $l_0$, time $t_2$ required for rotating the photoconductor 10 once, time $t_3$ required for rotating it twice, and time $t_4$ required for rotating it three times, are expressed as follows.

$$t_2=(l_0+l_1)/v \quad (8)$$

$$t_3=(2l_0+l_1)/v \quad (9)$$

$$t_4=(3l_0+l_1)/v \quad (10)$$

Assuming that the grid bias voltage $V_G$ applied to the grid screen 123 of the main charging unit 12 the unexposed are potentials corresponding to the times t, $t_2$, $t_3$ and $t_4$ are $SP_{01}$, $SP_{02}$, $SP_{03}$ and $SP_{04}$, and the exposed area potentials corresponding to these times are $SP_{L1}$, $SP_{L2}$, $SP_{L3}$ and $SP_{L4}$, the following equations are given.

$$SP_{01}=a\cdot V_G-b\cdot e^{-c+1}+d \quad (11)$$

$$SP_{L1}=p\cdot V_G-q\cdot e^{-r+1}+s \quad (12)$$

$$SP_{02}=a\cdot V_G-b\cdot e^{-c+2}+d \quad (13)$$

$$SP_{L2}=p\cdot V_G-q\cdot e^{-r+2}+s \quad (14)$$

$$SP_{03}=a\cdot V_G-b\cdot e^{-c+3}+d \quad (15)$$

$$SP_{L3}=p\cdot V_G-q\cdot e^{-r+3}+s \quad (16)$$

$$SP_{04}=a\cdot V_G-b\cdot e^{-c+4}+d \quad (17)$$

$$SP_{L4}=p\cdot V_G-q\cdot e^{-r+4}+s \quad (18)$$

The constants a and d are obtained by arranging the equations (11), (13), (15) and (17), and the constants p to s are obtained by arranging the equations (12), (14), (16) and (18).

Substituting the constants a to d, p to s, and times t and $t_2$ to $t_4$ in the equations (5) and (6), four grid bias voltages $V_G$ and developing bias voltage $V_{BD}$ are determined so that the intensities of the contrast voltage $V_C$ and background voltage $V_{BG}$, which are determined for each of the developing areas where the developing units 14 to 20 are located, and the ratio of $V_C$ to $V_{BG}$ can be made coincident with target values.

In the printer apparatus 100, a laser beam is emitted from the laser exposer 64 to the surface of the photoconductor 10 in accordance with a gradation pattern output from the pattern generator 76 when the grid bias voltage $V_G$ and developing bias voltage $V_{BD}$ are kept constant. The gradation pattern exposed to the surface of the photoconductor 10 is developed by means of one of the developing units 14, 16, 18 and 20 which corresponds to the developing area for setting the grid bias voltage $V_G$ and developing bias voltage $V_{BD}$. The toner attaching amount Q of toner attached to the developed gradation pattern, is measured by the attached-toner sensor 32. As has been described, the measured toner attaching amount Q is digitized by the A/D converter 80 and supplied to the main controller 70. The main controller 70 calculates a difference ΔQ between the toner attaching amount Q and the reference toner amount stored in the memory 84.

In the main controller 70, the contrast voltage $V_C$ and the background voltage $V_{BG}$ are estimated based on the difference ΔQ in order to acquire the optimum image density (ΔQ=0) for printing. More specifically, when ΔEQ is not 0, correction amounts $\Delta V_C$ and $\Delta V_{BG}$ of the contrast voltage $V_C$ and the background voltage $V_{BG}$ are calculated so that the toner attaching amount necessary for the image density of the developing area corresponding to each of the developing units coincides with the reference toner amount. With these correction amounts, a new grid bias voltage $V_G$ and a new developing bias voltage $V_{BD}$ are obtained from the equations (5) and (6).

Since the new grid bias voltage $V_G$ and the new developing bias voltage $V_{BD}$ are obtained, a laser beam corresponding to the gradation pattern is emitted, and the gradation pattern is developed by means of one of the developing units which corresponds to the developing area for setting the grid bias voltage $V_G$ and the developing bias voltage $V_{BD}$. The toner attaching amount Q is then calculated, and a difference ΔQ between the toner attaching amount Q and the reference toner amount is obtained again. Further, the contrast voltage $V_C$ and the background voltage $V_{BG}$ are estimated, and correction amounts $\Delta V_C$ and $\Delta V_{BG}$ of the contrast voltage $V_C$ and the background voltage $V_{BG}$ are calculated. The printer apparatus 100 repeats the above process until the difference ΔQ falls within a desired tolerance.

Figure 9:
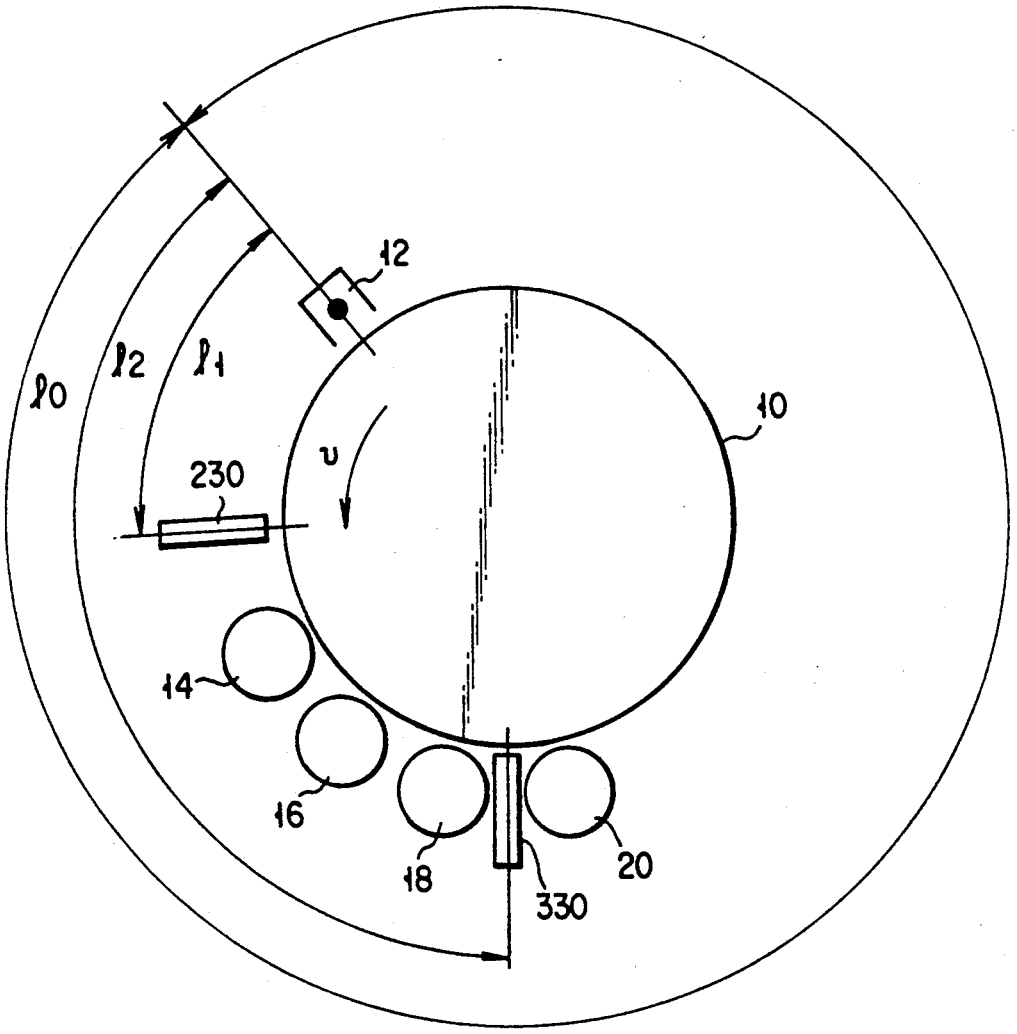
FIG. 9 is a schematic view of a modification to the system shown in FIG. 8.

To describe another embodiment, the system shown in FIG. 8 is replaced with a system having first and second surface potential sensors 230 and 330 as shown in FIG. 9. According to FIG. 9, since the apparatus 200 includes first and second surface potential sensors 230 and 330, time $t_1$ (seconds) and time $t_2$ (seconds) elapsed after the photoconductor is charged up, with respect to the surface potentials measured by these sensors, are given as follows.

$$t1 = l_1/v \quad (19)$$

$$t2 = l_2/v \quad (20)$$

$l_1$ and $l_2$ are distances along the circumference of the photoconductor 10 between a charging position to which charges are supplied from the main charging unit 12, and the first and second surface potential sensors 230 and 330, and v is a moving speed of the photoconductor 10. Assuming that the circumference of the photoconductor 10 is $l_0$, time $t_3$ and time $t_4$ required for rotating the photoconductor 10 once are expressed as follows.

$$t_3 = (l_0 + l_1)/v \quad (21)$$

$$t_4 = (l_0 + l_2)/v \quad (22)$$

Measuring the unexposed area potentials $SP_{O1}$ to $SP_{O4}$ and exposed area potentials $SP_{L1}$ to $SP_{L4}$, which correspond to elapsed times $t_1$ to $t_4$, in order to obtain the developing bias voltage $V_{BD}$ and the grid bias voltage $V_G$ in the printer apparatus 200, they can be expressed by the above equations (11) to (18). Even though the first and second surface potential sensors 230 and 330 are used, the constants a to d are obtained by arranging the equations (11), (13), (15) and (17), and the constants p to s are obtained by arranging the equations (12), (14), (16) and (18). Consequently, the grid bias voltage $V_G$ and developing bias voltage $V_{BD}$ are determined so that the intensities of the contrast voltage $V_C$ and background voltage $V_{BG}$ and the ratio of $V_C$ to $V_{BG}$, which are determined for each of developing areas where the developing units 14, 16, 18 and 20 are located, can be made coincident with target values. It is needless to say in this apparatus 200 that the voltages $V_G$ and $V_{BD}$ are controlled.

As described above, according to the printer apparatus of the present invention, the amount of charge (potential) applied to the photosensitive surface of the photoconductor 10 is measured at at least two points which differ in time.

Based on the measured surface potential, a variation in dark and light decay characters which control the density of an image to be printed, is recognized for the developing position of each developing unit. The grid bias voltage applied to the grid screen of the main charging device and the developing bias voltage applied to each of the developing units are set so as to satisfy the intensities of the contrast voltage $V_C$ and background voltage $V_{BG}$ predetermined for each of the developing positions of the developing units. Therefore, the variation in the density or color balance of an image to be printed out, which is caused by the secular changes or environmental changes, can be lessened.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An apparatus for forming an image on an image bearing member, comprising:

means for rotating said image bearing member;

means for charging said image bearing member rotated by said rotating means;

means for emitting a light beam to said image bearing member charged by said charging means so as to form a latent image on said image bearing member;

means for repeatedly detecting surface potentials of exposed areas and unexposed areas while said image bearing member is rotated by said rotating means;

means for developing the latent image formed on said image bearing member;

means for applying a developing bias voltage to said developing means;

means for estimating a surface potential of said image bearing member opposed to said developing means based on the surface potentials detected by said detecting means; and means for setting the developing bias voltage applied by said applying means in accordance with a decay character of the surface potential estimated by said estimating means.

2. The apparatus according to claim 1, wherein said detecting means includes a single sensor for repeatedly detecting surface potentials of exposed areas and unexposed areas while said image bearing member is being rotated by said rotating means.

3. The apparatus according to claim 1, wherein said detecting means includes a first sensor for detecting the surface potentials of an exposed area and an unexposed area, and a second sensor for detecting the surface potentials of an exposed area and an unexposed area.

4. The apparatus according to claim 1, further comprising:

second applying means for applying a grid bias voltage to said charging means; and second setting means for setting said grid bias voltage in accordance with said estimated surface potential on said image bearing means opposed to said developing means.

5. An apparatus for forming an image on an image bearing member, comprising:

means for rotating said image bearing member;

means for charging said image bearing member rotated by said rotating means;

means for emitting a light beam to said image bearing member charged by said charging means so as to form a latent image on said image bearing member;

means for repeatedly detecting a surface potentials of exposed areas and unexposed areas while said image bearing member is being rotated by said rotating means;

first developing means, opposed to said image bearing member, for developing the latent image formed on said image bearing member;

first applying means for applying a first developing bias voltage to said first developing means;

second developing means, opposed to said image bearing member, for developing the latent image formed on said image bearing member;

second applying means for applying a second developing bias voltage to said second developing means;

means for estimating the surface potentials on said image bearing member opposed to said first and second developing means based on the surface potentials in the exposed areas detected by said detecting means;

first setting means for setting said first developing bias voltage on said image bearing member opposed to said first developing means; and second setting means for setting said second developing bias voltage in accordance with said estimated surface potential on said image bearing member opposed to said second developing means.

6. The apparatus according to claim 5, wherein said detecting means includes a single sensor for repeatedly detecting surface potentials of exposed areas and unexposed areas while said image bearing member is being rotated by said rotating means.

7. The apparatus according to claim 5, further comprising:

third applying means for applying a grid bias voltage to said charging means; and third setting means for setting said grid bias voltage in accordance with said estimated surface potential on said image bearing means opposed to said first and second developing means.

8. The apparatus according to claim 5, wherein said detecting means includes a first sensor, located between said charging means and said first developing means, for repeatedly detecting the surface potentials of exposed areas and unexposed areas, and a second sensor, located on said first developing means and said second developing means, for repeatedly detecting the surface potentials of exposed areas and unexposed areas.

9. The apparatus according to claim 3, wherein said detecting means are in said first sensor which is located between said charging means and said developing means, and said second sensor is located behind said developing means.

* * * * *